US005209647A

United States Patent [19]

Bennitt

[11] Patent Number: 5,209,647

[45] Date of Patent: May 11, 1993

[54] STRAIGHT CYLINDER GAS COMPRESSOR WITH A REDUCED DIAMETER COMPRESSION CHAMBER

[75] Inventor: Robert A. Bennitt, Painted Post, N.Y.

[73] Assignee: Dresser-Rand Company, Corning, N.Y.

[21] Appl. No.: 899,805

[22] Filed: Jun. 17, 1992

[51] Int. Cl.[5] ..... F04B 23/00; F04B 25/00

[52] U.S. Cl. ..... 417/261; 417/259; 417/243

[58] Field of Search ..... 417/259, 260, 261, 243

[56] References Cited

U.S. PATENT DOCUMENTS

| | | | |
|---|---|---|---|
| 213,692 | 3/1879 | Richmond | 417/525 |
| 2,256,926 | 9/1941 | Maniscalco | 417/261 |
| 2,323,068 | 5/1943 | Maniscalco | 417/261 |
| 3,694,109 | 9/1972 | Walls | 417/261 |
| 4,111,609 | 9/1978 | Braun | 417/243 |
| 4,789,314 | 12/1988 | Higuchi et al. | 417/243 |
| 5,011,383 | 4/1991 | Bennitt | 417/534 |
| 5,015,158 | 5/1991 | Bennitt | 417/525 |

FOREIGN PATENT DOCUMENTS

| | | | |
|---|---|---|---|
| 0038892 | 3/1936 | Netherlands | 417/261 |

*Primary Examiner*—Richard A. Bertsch
*Assistant Examiner*—Alfred Basichas
*Attorney, Agent, or Firm*—Bernard J. Murphy

[57] ABSTRACT

A straight cylinder, clamped between end headers, confines valve assemblies wholly therewithin, and has a cylindrical sleeve set within one half length of the cylinder to effect a staging, i.e., a two-step compression, of the admitted gas.

10 Claims, 2 Drawing Sheets

STRAIGHT CYLINDER GAS COMPRESSOR WITH A REDUCED DIAMETER COMPRESSION CHAMBER

This invention pertains to gas compressors in which the compression cylinder thereof confines therewithin the inlet and discharge valves, and reciprocable ones of said valves are piston-ringed to serve, also, as the gas compressing pistons, and in particular to a gas compressor of the aforesaid type which is staged to provide two-step compression.

Gas compressors which have the inlet and discharge valves confined within the compression cylinder, and in which the reciprocable valves are piston-ringed, are disclosed in U.S. Pat. Nos. 5,011,383, issued on Apr. 30, 1991, to Robert A. Bennitt, for a Valve Assembly, for use in Combination with a Straight-Cylinder, Gas-Compression Chamber, and in Combination Therewith, and 5,015,158, also issued to Robert A. Bennitt, for a Gas Compressor, on May 14, 1991. For the general background which the aforesaid patents provide, the same are hereby incorporated by reference.

It is an object of the instant invention, then, to set forth a gas compressor comprising a straight cylinder having (a) a longitudinal axis, and (b) a circumferential wall; a cylindrical sleeve, within said cylinder, extending from one axial end of said cylinder to substantially a mid-length of said cylinder; a first, one-way valve assembly removably set within said cylinder, in adjacency to one axial end thereof; a second, centrally-bored, one-way valve assembly removably set within said sleeve, in adjacency to the opposite end of said cylinder; a piston rod reciprocably disposed within said cylinder and said sleeve, and in slidable penetration of said second valve assembly; wherein said rod has a terminal, drive end extending outwardly from said cylinder; a third, one-way valve assembly coupled to an innermost end of said rod; a fourth, one-way valve assembly coupled to, and intermediate the length of, said rod; radial porting formed in said wall for admitting gas to said first valve assembly; and radial porting formed in said wall and said sleeve for discharging compressed gas from said second valve assembly; wherein said first and third valve assemblies comprise means cooperative with reciprocation of said rod for compressing admitted gas to a first stage of compression; said second and fourth valve assemblies comprise means cooperative with such reciprocation of said rod for compressing admitted gas to a second stage of compression; said third valve assembly is sealingly engaged with the inner surface of said cylinder; and said fourth valve assembly is sealingly engaged with the inner surface of said sleeve.

Figure 1:
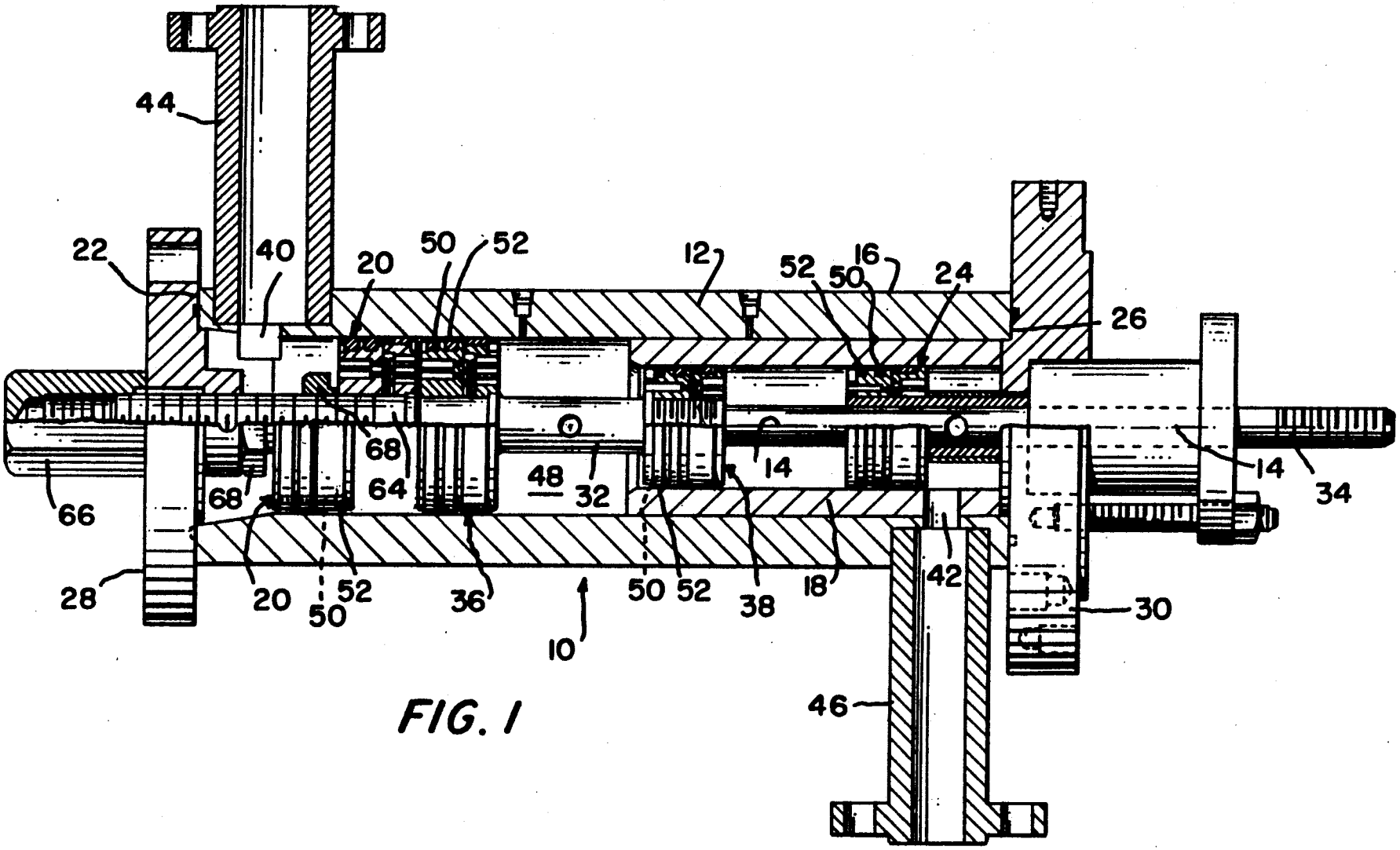
Figure 2:
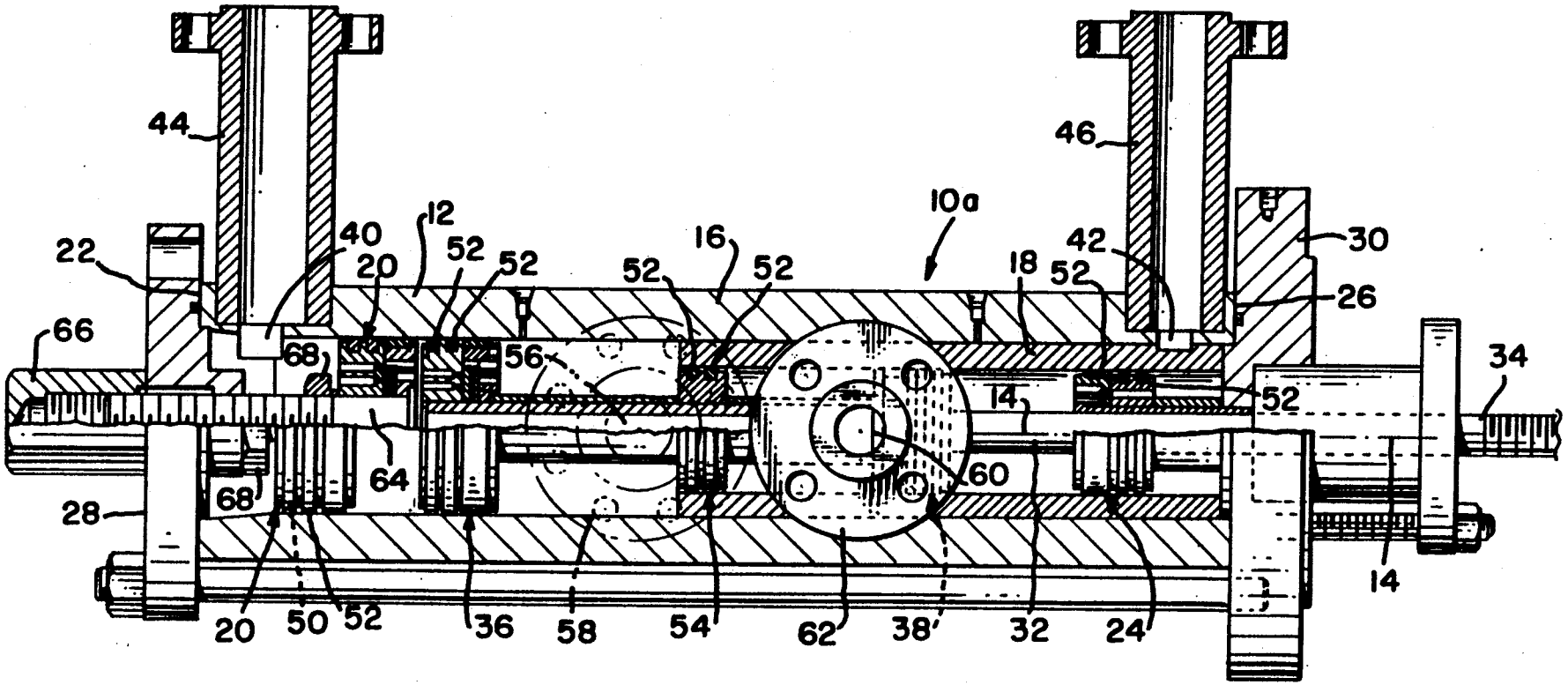

Further objects of this invention, as well as the novel features thereof, will become apparent from the following description, taken in conjunction with the accompanying figures, in which:

FIG. 1 is a side elevational view, half thereof in cross-section, of an embodiment of the invention; and FIG. 2 is a side elevational view, again, half thereof in cross-section, of an alternative embodiment of the invention.

As shown in FIG. 1, the novel gas compressor 10, according to a first embodiment thereof, has a straight cylinder 12 which has a longitudinal axis 14 and a circumferential wall 16. A cylindrical sleeve 18 is set within the cylinder 12, and extends from one end of the cylinder 12 to substantially a mid-length thereof. A first, one-way valve assembly 20 is removably set within the cylinder 12, in adjacency to axial end 22 of the cylinder. A second, centrally-bored, one-way valve assembly 24 is set within the cylinder in adjacency to axial end 26 of the cylinder 12. Headers 28 and 30 close off ends 22 and 26, and are secured in place by tie rods (not shown), as more fully described in the aforesaid U.S. Pat. No. 5,105,158. A piston rod 32 is reciprocably disposed within the cylinder 12 and the sleeve 18, and is in slidable penetration of the second valve assembly 24. The rod 32 has a terminal, drive end 34 which extends outwardly from the cylinder 12 for coupling thereof to a prime mover (not shown).

A third, one-way valve assembly 36 is coupled to the innermost end of the rod 32, and a fourth, one-way valve assembly 38 is coupled to the rod 32 intermediate the length of the rod. Gas inlet radial porting 40 is formed in the wall 16, adjacent to end 22 of the cylinder 12, for admitting gas to the first valve assembly 20, and gas outlet radial porting 42 is formed in the wall 16 and the sleeve 18 for discharging compressed gas from the second valve assembly 24. A flanged conduit 44 is joined to porting 40, and a flanged conduit 46 is joined to porting 42.

The valve assemblies 20, 24, 36 and 38 are of the plate-type, and correspond to the valve assembly disclosed in the aforecited U.S. Pat. No. 5,011,383.

With reciprocation of the rod 32 in the right-hand direction (with reference to the FIG. 1 depiction), valve assembly 36 will move toward the sleeve 18, and draw a vacuum between itself and valve assembly 20. As a consequence thereof, gas will be admitted through valve assembly 20 into a chamber 48. Then, with reciprocation of the rod 32 in the left-hand direction, the chamber-confined gas will be compressed to a first stage of compression between valve assemblies 20 and 36 and, at some given pressure threshold, will pass through valve assembly 36 and enter chamber 48. Coincidentally, during the same cycle, valve assembly 38 will draw a relative vacuum between itself and valve assembly 24, and with translation of valve assembly 38 to the left will pass the first state-compressed gas therethrough, from chamber 48. Then, with movement of valve assembly 38 to the right, this gas product will be compressed, between valve assemblies 38 and 24, to a second stage of compression. At another pressure threshold, the final compressed gas product will pass through valve assembly 24 to exit via porting 42 and conduit 46.

Valves 20, 24, 36 and 38 have pluralities of grooves 50 formed therein which nest sealing rings 52 therein. Consequently, the valve assemblies 36 and 38 serve the function of pistons (as more fully explained in cited U.S. Pat. No. 5,011,383). The chamber 48, which with translation of the rod 32 varies in volume, comprises both (a) a first compression stage compressed gas volume, and (b) a second compression stage suction volume. Where there obtains a reason to intercool the product compressed gas, between the two stages of compression, the invention sets forth an alternative embodiment of the invention, as depicted in FIG. 2.

In FIG. 2, index numbers which are the same or similar to those displayed on FIG. 1 denote same or similar components Compressor 10*a*, in FIG. 2 is of construction similar to compressor 10 of FIG. 1; except for its accommodation for intercooling. Between valve assemblies three and four, i.e., assemblies 36 and 38, is a fluid barrier. The latter comprises a circular sealing element 54. Element 54, like the valve assemblies, carries sealing rings 52 in grooves 50 provided therefor. It seals between left-hand and right-hand portions of the compression cylinder 12, and is coupled to the rod 32 intermediate the valve assemblies 36 and 38. In addition, a first stage discharge porting 56 and conduit 58 (shown in phantom) open onto the inner of the cylinder 12 between the element 54 and valve assembly 36, and a second stage porting 60 and conduit 62 open onto the inner of the cylinder 12 between element 54 and valve assembly 38. It remains only to interconnect an appropriate cooling device, between conduits 58 and 62, to provide for the interstage cooling.

As earlier noted herein, the valve assemblies 20, 24, 36 and 38 are constructed as disclosed in U.S. Pat. No. 5,011,383. Clearly, however, assemblies 20 and 36 are of larger diameter than valves assemblies 24 and 38. Valve assemblies 20 and 36, though, are identical and interchangeable, and valve assemblies 24 and 38 also are identical and interchangeable.

In each embodiment, i.e., compressors 10 and 10*a*, the valve assembly 20 is mounted on a stub shaft 64. Shaft 64 has an outermost threaded end which is threadedly engaged with header 28 and receives a threaded cap nut 66 at the termination thereof. Too, stub shaft 64 has a hexagonal lug formed thereon intermediate the length thereof. The lug 68 can be engaged and turned by a wrench to adjust the positioning of valve assembly 20, as a means of varying the compression level to be achieved in the first stage of compression. In both FIGS. 1 and 2, the valve assembly 20 is horizontally split; the cross-section half depicts the valve assembly 20 set in its innermost positioning, and the full-line half thereof depicts the same in its outermost poistioning.

While I have described my invention in connection with specific embodiments thereof, it is to be clearly understood that this is done only by way of example, and not as a limitation to the scope of the invention as set forth in the objects thereof and in the appended claims.

I claim:

1. A gas compressor, comprising:

a straight cylinder having (a) a longitudinal axis, and (b) a circumferential wall;

a cylindrical sleeve, within said cylinder, extending from one axial end of said cylinder to substantially a mid-length of said cylinder;

a first, one-way valve assembly removably set within said cylinder, in adjacency to one axial end thereof;

a second, centrally-bored, one-way valve assembly removably set within said sleeve, in adjacency to the opposite axial end of said cylinder;

a piston rod reciprocably disposed within said cylinder and said sleeve, and in slidable penetration of said second valve assembly; wherein said rod has a terminal, drive end extending outwardly from said cylinder;

a third, one-way valve assembly coupled to an innermost end of said rod;

a fourth, one-way valve assembly coupled to, and intermediate the length of, said rod;

radial porting formed in said wall for admitting gas to said first valve assembly; and radial porting formed in said wall and said sleeve for discharging compressed gas from said second valve assembly; wherein said first and third valve assemblies comprise means cooperative with reciprocation of said rod for compressing admitted gas to a first stage of compression;

said second and fourth valve assemblies comprise means cooperative with such reciprocation of said rod for compressing admitted gas to a second stage of compression;

said third valve assembly is sealingly engaged with the inner surface of said cylinder; and said fourth valve assembly is sealingly engaged with the inner surface of said sleeve.

2. A gas compressor, according to claim 1, wherein:

said third and fourth valve assemblies each have a plurality of grooves formed in the periphery thereof, and have sealing rings confined within said grooves.

3. A gas compressor, according to claim 1, wherein:

said first and third one-way valve assemblies are identical and interchangeable.

4. A gas compressor, according to claim 1, wherein:

said second and fourth one-way valve assemblies are identical and interchangeable.

5. A gas compressor, according to claim 1, wherein:

said third and fourth one-way valve assemblies define, therebetween, in cooperation with said cylinder and said sleeve, a chamber which comprises both (a) a first compression stage compressed gas volume, and (b) a second compression stage suction volume.

6. A gas compressor, according to claim 5, wherein:

with reciprocation of said rod, said chamber is of varying volume.

7. A gas compressor, according to claim 1, further including:

fluid barrier means interposed between said third and fourth one-way valve assemblies.

8. A gas compressor, according to claim 7, wherein:

said barrier means comprises a circular sealing element sealingly engaged with the innersurface of said sleeve.

9. A gas compressor, according to claim 8, wherein:

said element is coupled to said rod intermediate said third and fourth one-way valve assemblies.

10. A gas compressor, according to claim 1, further including:

radial porting formed in said wall for discharging compressed gas from said third one-way valve assembly; and radial porting formed in said wall and sleeve for admitting gas to said fourth one-way valve assembly.

* * * * *